US012453404B2

(12) United States Patent
Armitage

(10) Patent No.: US 12,453,404 B2
(45) Date of Patent: Oct. 28, 2025

(54) BACKPACK WITH SHOULDER STRAPS CROSSING AND NON-FIXED AT TOP TO SUPPORT LOAD FROM BASE

(71) Applicant: Graham Mark Armitage, Calgary (CA)

(72) Inventor: Graham Mark Armitage, Calgary (CA)

( * ) Notice: Subject to any disclaimer, the term of this patent is extended or adjusted under 35 U.S.C. 154(b) by 116 days.

(21) Appl. No.: 18/073,812

(22) Filed: Dec. 2, 2022

(65) Prior Publication Data

US 2023/0172344 A1 Jun. 8, 2023

(30) Foreign Application Priority Data

Dec. 6, 2021 (CA) ..... CA 3141175

(51) Int. Cl.
*A45F 3/04* (2006.01)
*A45F 3/08* (2006.01)

(52) U.S. Cl.
CPC ..... *A45F 3/047* (2013.01); *A45F 3/08* (2013.01); *A45F 2003/045* (2013.01)

(58) Field of Classification Search
CPC ..... A45F 3/047; A45F 3/08; A45F 2003/045
USPC ..... 224/637
See application file for complete search history.

(56) References Cited

U.S. PATENT DOCUMENTS 2,262,313 A * 11/1941 Clappier ..... A45F 3/04 224/655
3,957,184 A * 5/1976 Shurman ..... A45F 3/04 224/630
5,184,764 A * 2/1993 Orovan ..... A45F 3/08 224/636
5,415,332 A * 5/1995 Kliot ..... A45F 3/02 150/108
5,449,102 A * 9/1995 Sason ..... A45F 3/047 224/632
5,927,581 A * 7/1999 Reddy ..... A45F 3/04 224/655

(Continued)

OTHER PUBLICATIONS

Dog in Chief, "The Swedish "Moose Sack"", Apr. 13, 2019, https://leansoliddogs.blog/2019/04/13/the-swedish-moose-sack/.

(Continued)

*Primary Examiner* — Peter N Helvey
(74) *Attorney, Agent, or Firm* — Lewellyn Law, PLLC; Stephen Lewellyn

(57) ABSTRACT

A backpack includes right and left shoulder straps that each respectively follows a path starting with a fixed connection at a bottom corner of a back panel. A padded portion extends upwards and then proceeds through an upper ring on the same side of the backpack. The strap then extends back down while crossing over to another fixed connection to a bottom corner on the other side of the back panel. At the top ring, the strap is merely guided back down and is not fixed relative to the ring. Curved frame stays on the left, right and bottom of the back panel have concave shape toward the user. A hipbelt attaches to the backpack with pin connections to allow rotational motion therebetween while preventing lateral motion. Outside straps reduce strain on the backpack fabric and side pockets are passthrough for insertion of objects therebetween while still allowing pocket usage.

16 Claims, 15 Drawing Sheets

(56) References Cited

U.S. PATENT DOCUMENTS 6,164,509 A * 12/2000 Gausling ..... A45F 3/047 224/259
6,189,750 B1 * 2/2001 Von Neumann ..... A45C 15/00 224/582
6,286,461 B1 * 9/2001 Martz ..... A01K 1/0254 119/497
6,311,884 B1 * 11/2001 Johnson ..... A45F 3/14 224/153
6,460,746 B1 * 10/2002 Amram ..... A45F 3/047 224/628
6,550,651 B1 * 4/2003 Murdoch ..... A45C 13/262 224/580
6,793,112 B2 * 9/2004 Ammerman ..... A45F 3/02 224/264
7,160,028 B1 * 1/2007 Linday ..... A45C 9/00 150/108
7,204,399 B2 * 4/2007 Collier ..... A45F 3/047 224/259
7,931,178 B2 4/2011 Rome et al.
8,172,117 B2 * 5/2012 Maggi ..... A45F 3/047 224/604
8,231,037 B2 * 7/2012 Sacks ..... A45F 3/14 224/153
8,746,523 B1 * 6/2014 Woolley ..... A45C 13/30 224/578
8,998,051 B2 * 4/2015 Demskey ..... A45C 15/00 224/628
9,167,883 B2 * 10/2015 Demskey ..... A45F 3/04
9,439,501 B2 * 9/2016 Demskey ..... A47D 13/025
9,492,003 B2 * 11/2016 Patel ..... A45C 9/00
9,826,817 B2 * 11/2017 Whitehill ..... A45C 3/00
10,010,159 B1 * 7/2018 Gonzales ..... A45F 3/047
10,617,194 B2 * 4/2020 Rogers ..... A45F 3/08
D902,598 S * 11/2020 Chung ..... A45C 13/30 D3/327
11,470,947 B2 * 10/2022 Linday ..... A45C 9/00
2006/0131355 A1 * 6/2006 Tate ..... A45F 3/047 224/637
2008/0277434 A1 * 11/2008 Sacks ..... A45C 13/30 224/579
2010/0213224 A1 * 8/2010 Barr ..... A45C 9/00 224/645
2010/0270348 A1 * 10/2010 Demskey ..... A45F 3/14 224/579
2015/0136824 A1 * 5/2015 Demskey ..... A45F 3/02 29/25.35
2016/0100673 A1 * 4/2016 Demskey ..... A45C 13/30 224/257
2016/0128394 A1 * 5/2016 Kohrman ..... A45F 3/14 2/102
2019/0075912 A1 * 3/2019 Squires ..... A45F 3/04

OTHER PUBLICATIONS

Haynes, Heinnie; "Molles, Pals and ALICE Packs - What's the difference?", Aug. 6, 2015, https://heinnie.com/blog/molle-pals-alice-packs-bags/.

* cited by examiner

BACKPACK WITH SHOULDER STRAPS CROSSING AND NON-FIXED AT TOP TO SUPPORT LOAD FROM BASE

CROSS-REFERENCE TO RELATED APPLICATIONS

This application claims the benefit of priority of Canadian Patent Application No. 3,141,175 filed Dec. 6, 2021, which is incorporated herein by reference.

BACKGROUND OF THE INVENTION

(1) Field of the Invention

The invention pertains generally to backpacks. More specifically, the invention relates to a backpack with shoulder straps crossing and non-fixed at a top portion to thereby support the load by lifting from the pack base.

(2) Description of the Related Art

Backpacks typically either use an internal rigid frame sheet, an external rigid frame, or no frame, and are designed with all rigid components. Most packs are a bag attached to a rigid frame, with straps fastened; or packs have an internal frame with integral straps and hipbelt.

A drawback of common backpacks is that they require the user's body to adjust to load transfer and/or movements. Furthermore, packs which do not provide a high level of customizability require the user to compromise on the use.

BRIEF SUMMARY OF THE INVENTION

According to an exemplary embodiment of the invention there is disclosed a highly customizable backpack having a new method of framing, which reduces forces on the user's body to improve stability, comfort and customizability.

According to an exemplary embodiment of the invention there is disclosed a pack that has the shoulder straps non-fixed at the top portion of the back panel and that cross each other on the way back down to fixed connections at the bottom thereby lifting up and supporting the load from the base of the pack.

According to an exemplary embodiment of the invention there is disclosed a method of framing for a backpack which reduces forces on the body, improves stability, comfort, and customizability.

According to an exemplary embodiment, disclosed is a pack including two padded shoulder straps and a side pocket with additional side straps for reducing stresses on the bag fabric.

According to an exemplary embodiment of the invention there is disclosed a backpack with crisscrossed shoulder straps that lift from the bottom instead of pulling up from the top. Hipbelt attachments allow rotations by utilizing a pin connection but still provide lateral support. The hipbelt support attachments include dual three-bar adjusters disposed on the hipbelt for coupling with D-rings disposed on the back panel of the pack. Inside horizontal frame stay pockets facing horizontally toward each other on the back panel support a horizontal frame stay mounted therebetween, and outside vertical frame stay pockets facing vertically toward each other on the back panel support a vertical frame stay mounted therebetween.

According to an exemplary embodiment, a backpack includes right and left shoulder straps that each respectively follows a path starting with a fixed connection attached to a bottom corner. A padded portion extends upwards and then proceeds through an upper ring on the same side of the backpack. The strap then extends back down while crossing over to another fixed connection to a bottom corner on the other side of the backpack. The top ring acts as a non-fixed, passthrough connection. At the top ring, the strap is merely guided back down and is not fixed relative to the ring. A hipbelt is attached to the backpack with one or more pin connections to allow rotational motion therebetween while preventing lateral motion. Outside vertical continuous straps around the front of the backpack reduce strain on the backpack fabric and side pockets include a gap between the pocket and a backpack side for insertion of objects therebetween while still allowing pocket usage.

According to an exemplary embodiment of the invention there is disclosed a backpack including a main bag portion. The main bag portion having a back panel that faces a body of a user when the backpack is worn by the user. A right shoulder strap extends upwards from a first fixed connection located within a bottom-right area of the back panel, passing through a first ring secured within a top-right area of the back panel, and extending down from the first ring to a second fixed connection located within a bottom-left area of the back panel. The right shoulder strap passes through the first ring but is not otherwise fixed to the first ring. A left shoulder strap extends upwards from a third fixed connection located within the bottom-left area of the back panel, passing through a second ring secured within a top-left area of the back panel, and extending down from the second ring to a fourth fixed connection located within the bottom-right area of the back panel. The left shoulder strap passes through the second ring but is not otherwise fixed to the second ring.

Exemplary benefits of some embodiments include improved comfort and stability from the shoulder straps and/or hipbelt connections and the ability to remove and/or replace the frame thereby improving the use of the pack, customization and possibilities for repair.

These and other advantages and embodiments of the present invention will no doubt become apparent to those of ordinary skill in the art after reading the following detailed description of preferred embodiments illustrated in the various figures and drawings.

BRIEF DESCRIPTION OF THE DRAWINGS

The invention will be described in greater detail with reference to the accompanying drawings which represent preferred embodiments thereof.

DETAILED DESCRIPTION

Figure 1:
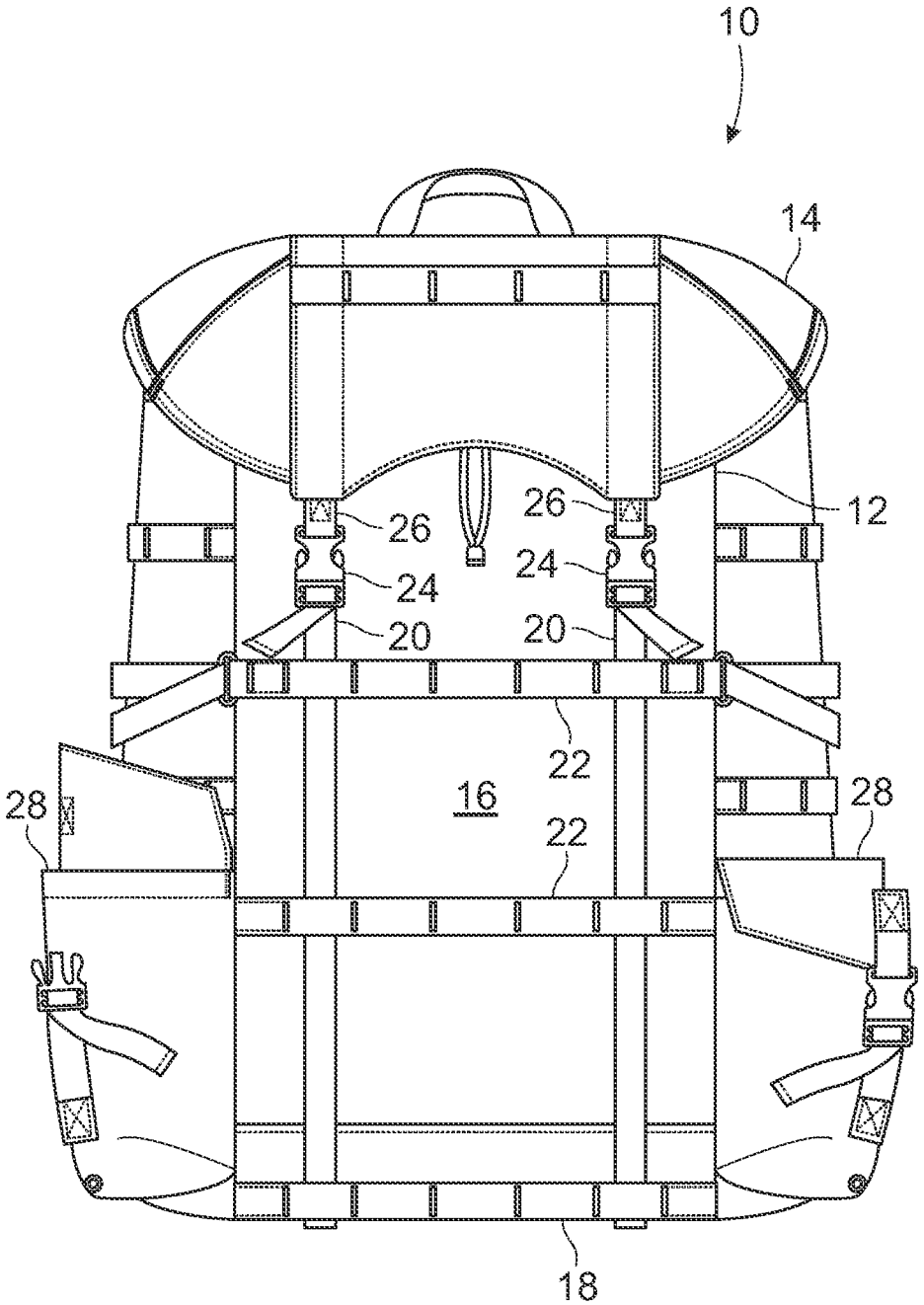
FIG. 1 illustrates a front elevational view of a backpack according to an exemplary embodiment.

FIG. 1 illustrates a front elevational view of a backpack 10 according to an exemplary embodiment. The pack 10 includes a main bag portion 12 for the user to store contents therein. The main bag portion 12 may include one or more inner zippered pockets with key clips, and these inner pockets may be used for holding tablets and other accessories. A top lid section 14 with another inner zippered pocket is provided for covering a top opening to the main bag section 12. The main bag portion 12 has a front panel 16, which faces away from the body of the user when the backpack 10 is worn. In some embodiments, the front panel 16 and lid section 14 may be formed of a fabric material such as tarpaulin having densities ranging from 600 D to 400 D. A bottom 18 of the main bag portion 12 may be formed by ballistic abrasion resistant tarpaulin for additional strength and protection from the bottom 18 of the pack 10 scratching on rocks or other surfaces when placed on the ground. In preferred embodiments, the fabric used to construct the backpack 10 is durable, water resistant and lightweight.

The front panel 16 in this embodiment includes two vertical straps 20 and two horizontal straps 22 formed from a material such as 1.5" nylon webbing/MOLLE webbing with all stress points bartacked. As is described further in the below, the vertical straps 20 connect via buckle clips 24 to corresponding vertical straps 26 extending downward from the lid section 14. Large side pockets 28 are provided, one on each lower side of the main bag portion 12.

Figure 2:
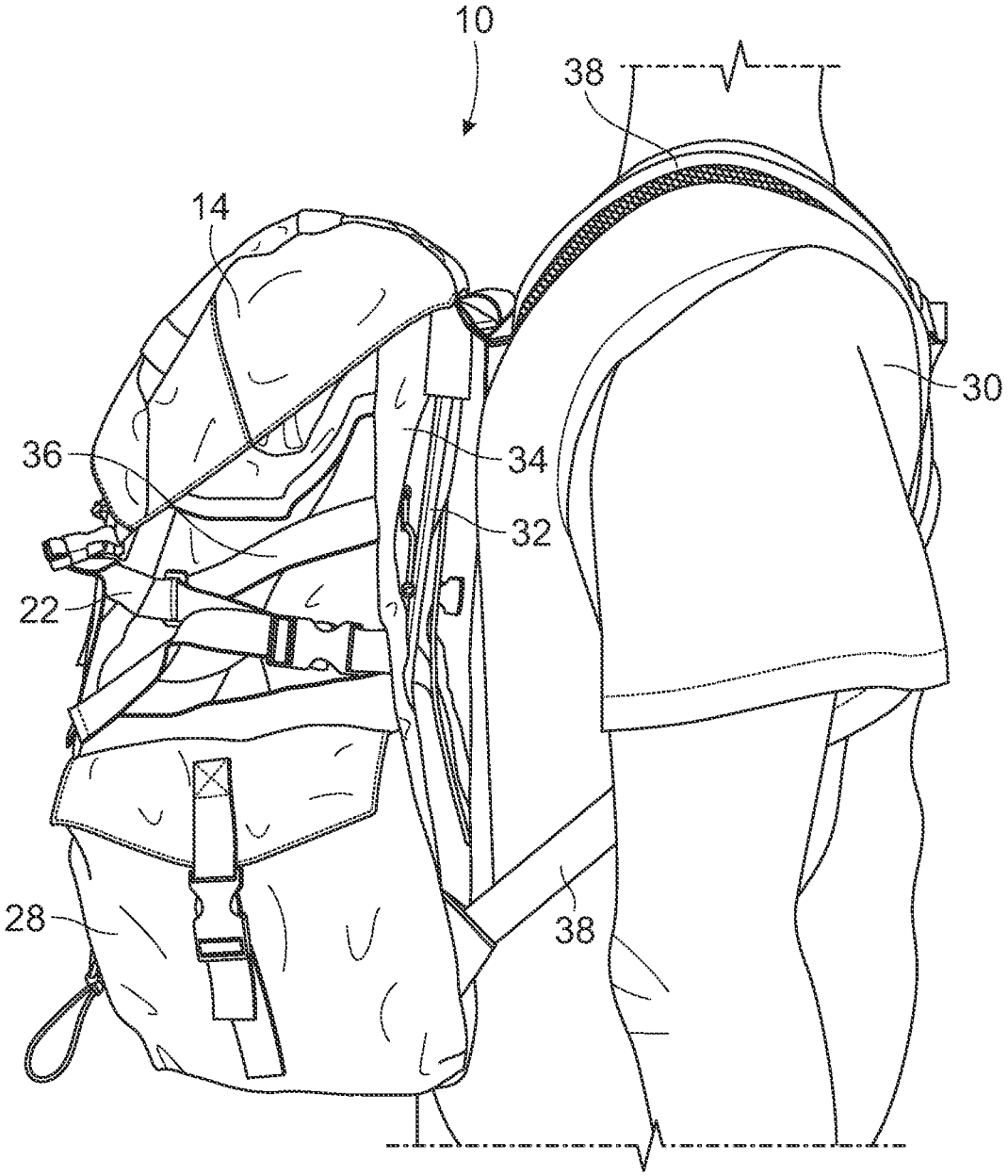
FIG. 2 illustrates a right side elevational view of the backpack of FIG. 1 while being worn by a user according to an exemplary embodiment.

FIG. 2 illustrates a right side elevational view of the backpack 10 of FIG. 1 while being worn by a user 30 according to an exemplary embodiment. The side view illustrates how a rigid or semi-rigid vertical frame stay bar 32 is mounted to the back panel 34 of the main bag portion and is curved with a convex shape facing toward the user's body. As illustrated, the horizontal straps 22 are coupled via self-cinching side accessory straps 36. Shoulder straps 38 are disposed on the back panel 34 for carrying the pack 10 by the user 30.

Figure 3:
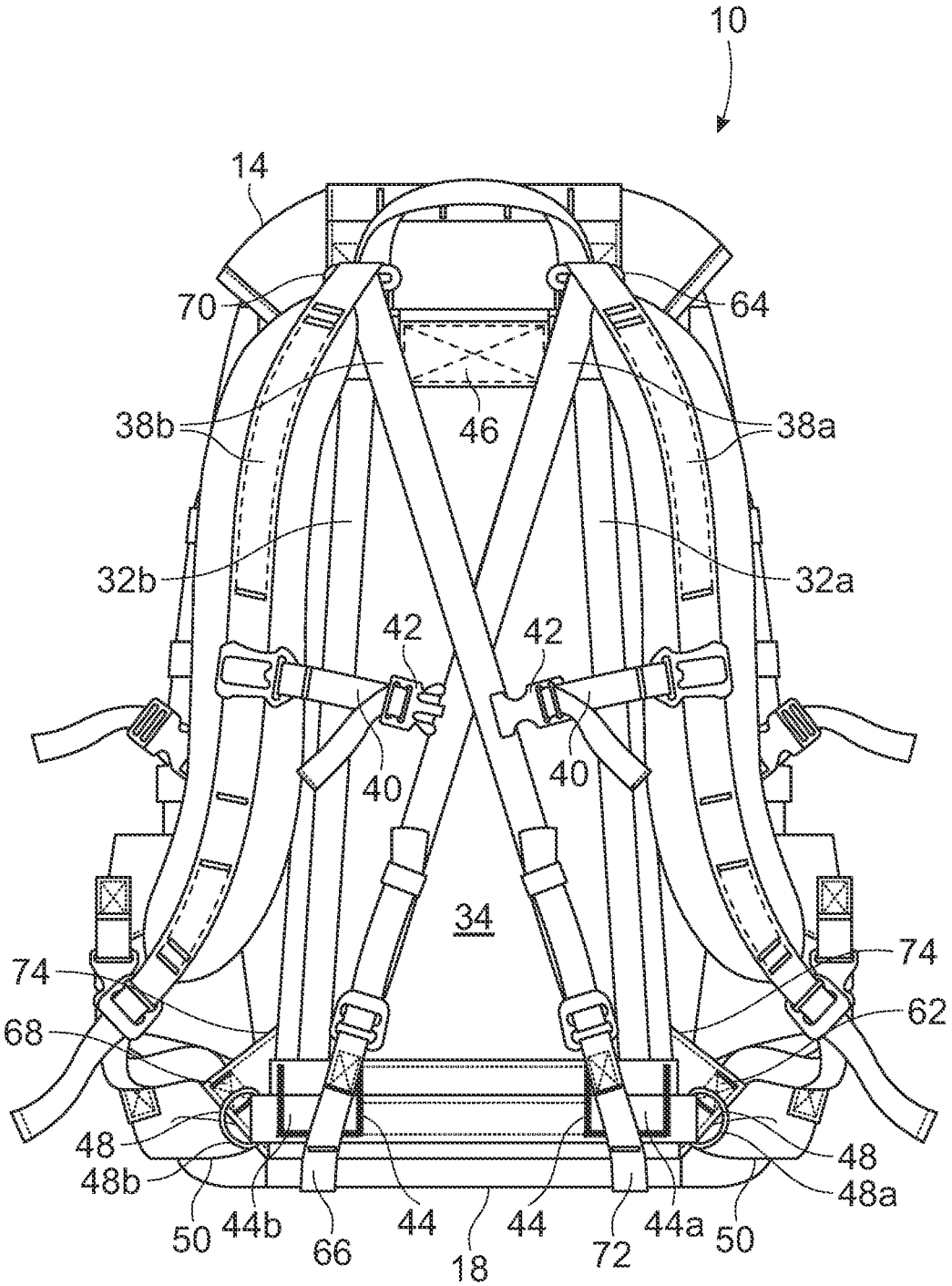
FIG. 3 illustrates a rear elevational view of the backpack of FIG. 1 according to an exemplary embodiment.

FIG. 3 illustrates a rear elevational view of the backpack 10 of FIG. 1 according to an exemplary embodiment. As is illustrated, the right side of the back panel 34 includes a right shoulder strap 38*a* and a right vertical frame stay 32*a*, and the left side of the back panel 34 includes a left shoulder strap 38*b* and a left vertical frame stay 32*b*. Each of the shoulder straps 38*a,b* includes a padded portion with breathable mesh. Chest straps 40 extend from each shoulder strap 38*a,b* and include a buckle clip 42 at their ends for attachment/detachment. The right frame stay 32*a* is formed by a first bar member mounted vertically on a right side of the back panel 34 and the left frame stay 32*b* is formed by a second bar member mounted vertically on a left side of the back panel 34. The frame stays 32*a,b* may be made of aluminum, wood, or carbon fibre. As described in further details below, the bottoms of the vertical frame strays 32*a,b* in this embodiment are held by lower frame stay pockets 44 and the tops are inserted into and held in opposite sides of a single upper frame stay pocket 46.

The back panel 34 in this embodiment further includes bottom rings 48 including a right bottom ring 48*a* secured within a bottom-right area of the back panel 34 and a left bottom ring 48*b* secured within a bottom-left area of the back panel 34. The bottom rings 48 are utilized to secure an optional hipbelt, which is described later in conjunction with FIGS. 16-19.

As detailed in FIG. 3, in some embodiments, the side pockets 28 are raised slightly from the bottom 18 of the pack 10. In this way, the bottoms 50 of the side pockets 28 are above the bottom 18 of the pack 10 and the pocket bottoms 50 are protected from abrasion when the backpack 10 is placed on the ground by the user.

In this description, the terms 'right' and 'left' are with respect to the drawings where the right shoulder strap 38*a* is on the right side of FIG. 3 and the left shoulder strap 38*b* is on the left side. Likewise, the 'front' of the backpack 10 in this description is the side (shown in FIG. 1) that faces away from the user 30 and the 'back' is the side (shown in FIG. 3) that faces toward the user 30. However, it should be noted that these labels are selected merely for convenience of explanation and reference to the drawings. They may be swapped without otherwise changing the technical features and backpack 10 structure. If the pack 10 is worn on the user's chest (i.e., a frontpack), the front, back, left, right labels used herein will likely agree with those given by the user 30. However, in most cases the user 30 will wear the pack on their back as shown in FIG. 2. From such a user's point of view, the user 30 may refer to the right and left shoulder straps 38*a,b* oppositely as given in this description such as according to the shoulder over which the strap 38 is suspended. Likewise, when the backpack 10 is worn on the user's back, the user 30 may also refer to what is referred to herein as the "front" of the backpack 10 as the "back". Since the left and right sides of the backpack 10 in this embodiment are the same, i.e., the pack 10 is symmetrical across the right and left sides, the different "right"/"left" label conventions makes no difference. Likewise, if desired, the terms "front" and "back" in this description may also be reversed without otherwise changing the illustrated features.

Following the right and left sides as illustrated in FIG. 3, the right shoulder strap 38*a* follows a path extending upwards from a first fixed connection 62 located within a bottom-right area of the back panel 34, passing through a first ring 64 secured within a top-right area of the back panel 34, and then extending down from the first ring 64 to a second fixed connection 66 located within a bottom-left area of the back panel 34. Of particular note, the first ring 64 is a non-fixed, passthough connection and the right shoulder strap 38*a* passes through the first top ring 64 but is not otherwise fixed to the first ring 64. Likewise, on the left side, the left shoulder strap 38*b* extends upwards from a third fixed connection 68 located within the bottom-left area of the back panel 34, passing through a second ring 70 secured within a top-left area of the back panel 34, and extending down from the second ring 70 to a fourth fixed connection 72 located within the bottom-right area of the back panel 34. The second top ring 70 is a non-fixed, passthrough connection and the left shoulder strap 38*b* passes through the second top ring 70 but is not otherwise fixed to the second ring 70. The first and second top rings 64, 70 in this embodiment are metal rings having an oblong inner eye slot that is a short and wide to help avoid the shoulder straps passing therethrough from twisting in the ring. The first and third fixed connection points 62, 68 are formed on triangular sections of fabric 74 affixed respectfully to the bottom right and left corners of the back panel 34 in this embodiment.

Figure 4:
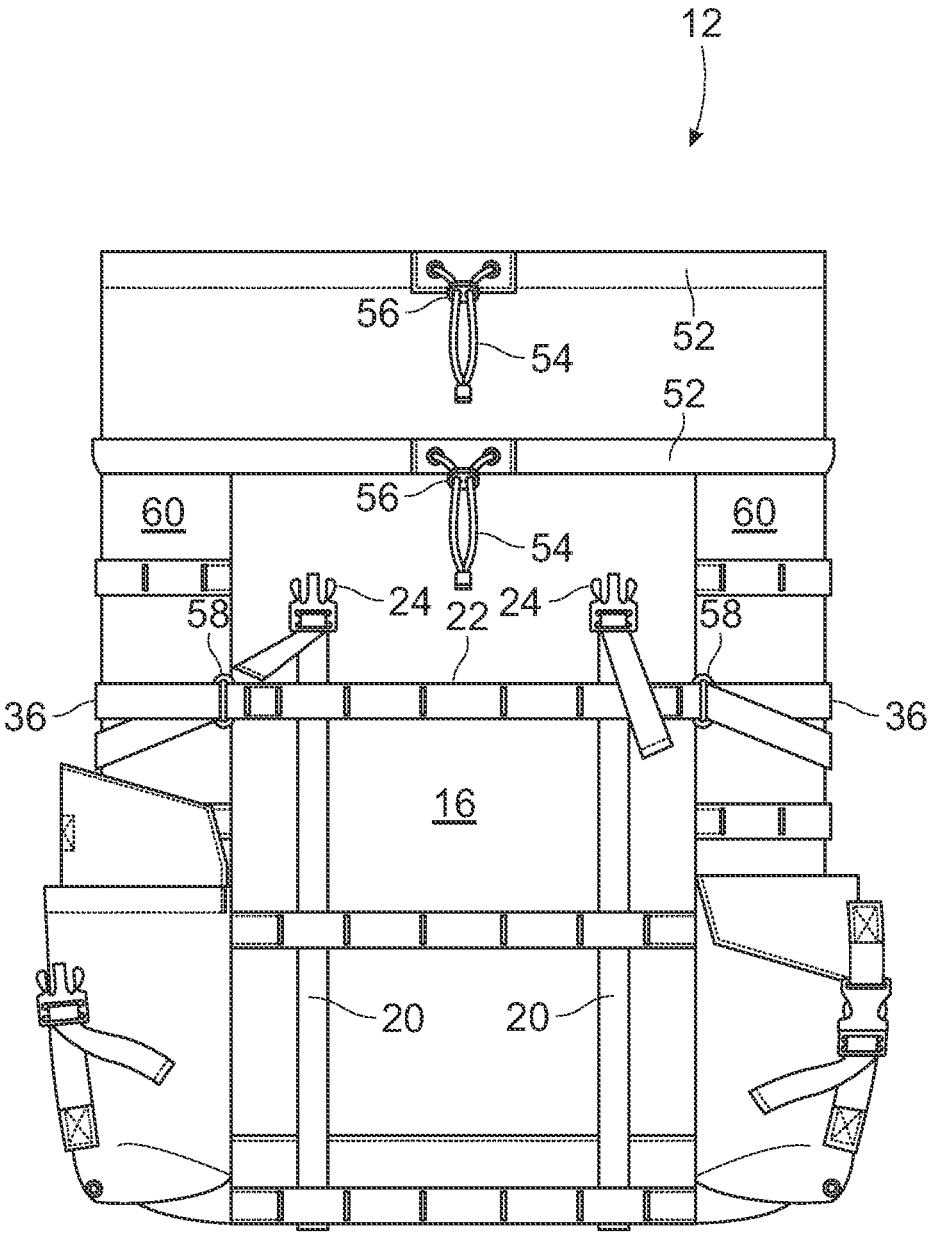
FIG. 4 illustrates a front elevational view of the front panel of main bag portion of FIG. 1 opened and flattened according to an exemplary embodiment.

FIG. 4 illustrates a front elevational view of the front panel 16 of main bag portion 12 of FIG. 1 opened and flattened according to an exemplary embodiment. As illustrated, two drawcord casings 52 are stitched into the top of the bag 12 and have corresponding drawcords 54 and cord locks 56. The two drawcords 54 form a "snow skirt" that double secures the bag 12 when the contents are few and also allows the bag 12 to be enlarged if needed to store additional contents. Tape connector rings 58 are provided on the horizontal straps 22 to allow connection with the side straps 36. Buckle connectors 24 are provided on the tops of the vertical straps 20 running upwards on the front panel for attaching to the corresponding buckles on the vertical straps 26 running downwards from the lid section 14.

Figure 5:
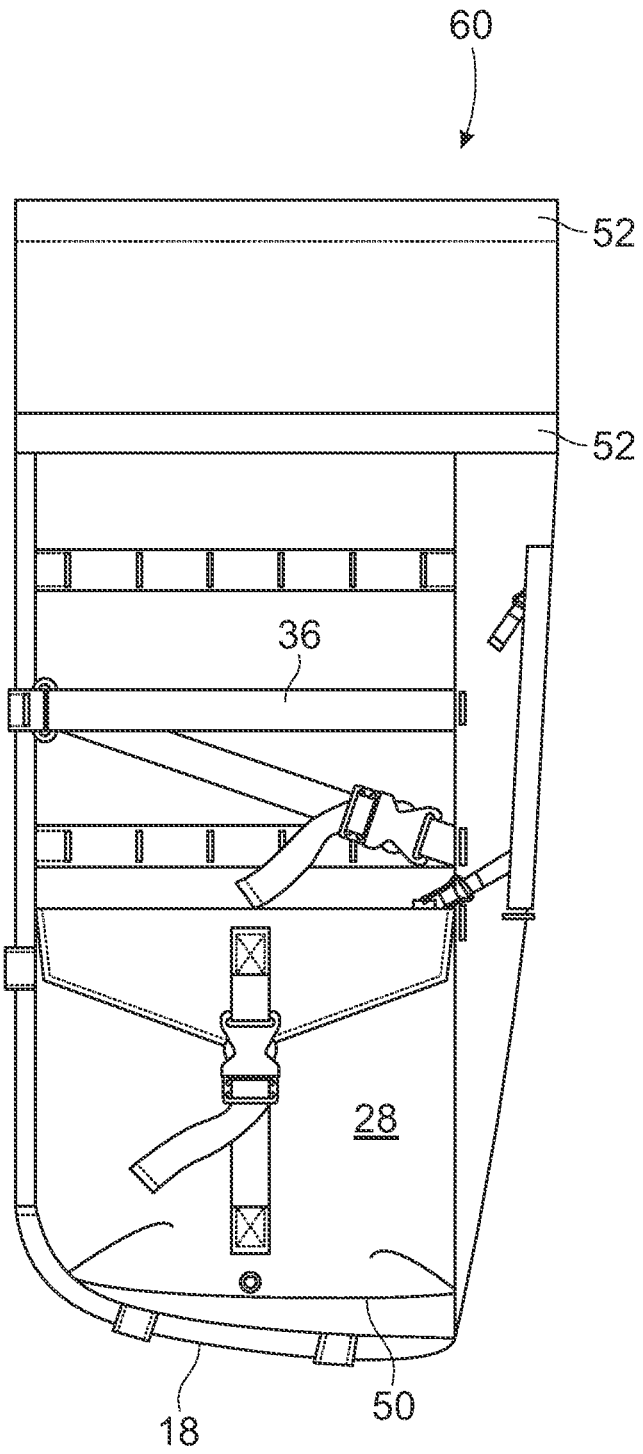
FIG. 5 illustrates an elevational view of a side panel of the main bag portion of FIG. 1 opened and flattened according to an exemplary embodiment.

FIG. 5 illustrates an elevational view of a side panel 60 of the main bag portion 12 of FIG. 1 opened and flattened according to an exemplary embodiment.

Figure 6:
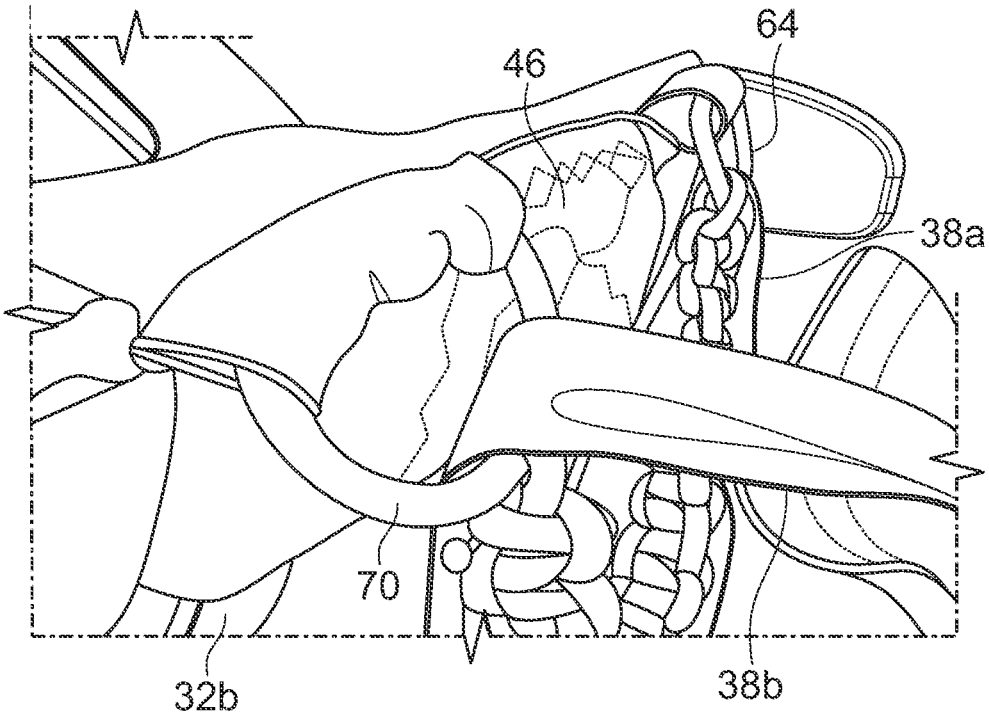
FIG. 6 illustrates a perspective view of using D-rings for the rings within the top left and right portions of the back panel according to an exemplary embodiment.

FIG. 6 illustrates a perspective view of using D-rings for the top rings 64, 70 within the top left and right portions of the back panel 34 according to an exemplary embodiment. The left shoulder strap 38*b* passes through the eye of the D-ring 70 on the top-left side and the right shoulder strap 38*a* passes through the eye of the D-ring 64 on the top-right side. The rings 64, 70 in this embodiment are D-rings instead of oblong rings. Although D-rings allow twisting of the shoulder strap to occur more easily, the D-rings also facilitate the user to easily and rapidly untwist the straps in the event that they do get twisted.

As illustrated in FIG. 3 and in the enlarged view of FIG. 6, each of the padded shoulder straps 38*a,b* is secured to the backpack 10 at the top by passing through a respective metal ring 64, 70. While providing a point of contact to the top portion of the bag 12, these metals rings 64, 70 allow the shoulder straps 38*a,b* to pass therethrough without otherwise limiting motion of the strap 38*a,b* moving through the ring 64, 70. In other words, the connection of the shoulder straps 38*a,b* at the top of the backpack 10 is not fixed—the shoulder straps 38*a,b* may move relative to the top of the backpack 10 through the top rings 64, 70.

As illustrated in FIG. 3, both the right frame stay 32*a* and the left frame stay 32*b* are mounted on an outside of the back panel 34 and are removable and installable by the user. The bottom end of the right frame stay 32*a* is inserted into a first frame stay pocket 44*a* formed within the bottom-right area of the back panel 34, and the bottom end of the left frame stay 32*b* is inserted into a second frame stay pocket 44*b* formed within the bottom-left area of the back panel 34. The top end of the right frame stay 32*a* and the top end of the left frame stay 32*b* are inserted into a single upper frame stay pocket 46 that spans between the top-right area and the top-left area of the back panel 34.

Figure 7:
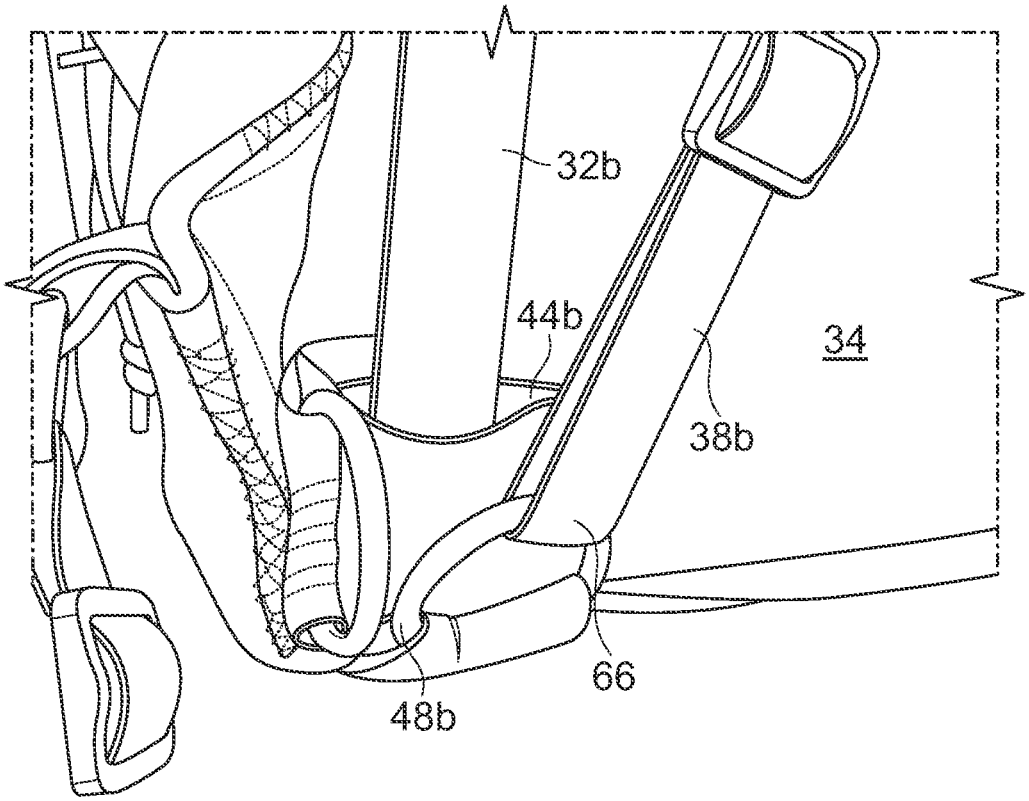
FIG. 7 illustrates an enlarged perspective view of the frame stay pocket on a lower left side of the backpack of FIG. 1 according to an exemplary embodiment.

FIG. 7 illustrates an enlarged perspective view of the frame stay pocket 44*b* on a lower left side of the backpack 10 of FIG. 1 according to an exemplary embodiment. As shown, the left frame stay 32*b* sits within a pocket 44*b*, and the pocket 44*b* in combination with a corresponding upper pocket 46 (see FIG. 3) holds the frame stay 32*b* in compression such that the frame stay 32*b* provides vertical support to the backpack 10. A similar pocket 44*a* is also provided on the bottom-right corner of the back panel 34 for holding the bottom end of the right frame stay 32*a*. As shown, each lower pocket 44 within the bottom area of the back panel 34 has its opening facing upwards in order to accept the end of vertically orientated frame stay 32. Likewise, the upper pocket 46 on the upper area of the back panel 34 has its opening facing downwards to accept the other end of the vertically orientated frame stays 32. The distances between the top and bottom pockets 46, 44 is such that each of the vertical frame stays 32 is held secure in compression and will not accidentally fall out of the pockets 44.

Figure 8:
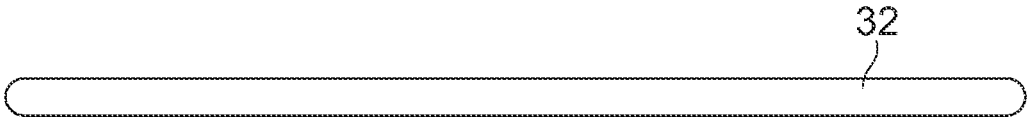
FIG. 8 illustrates a top plan of a vertical frame stay as it would be seen when removed from the backpack and lying on a flat surface such as a table top according to an exemplary embodiment.

FIG. 8 illustrates a top plan of a vertical frame stay 32 as it would be seen when removed from the backpack and lying on a flat surface 76 such as a table top according to an exemplary embodiment. In this embodiment, both the right and left vertical frame stays 32*a,b* are identical rigid or semi-rigid, elongated bar members with rounded corners.

Figure 9:
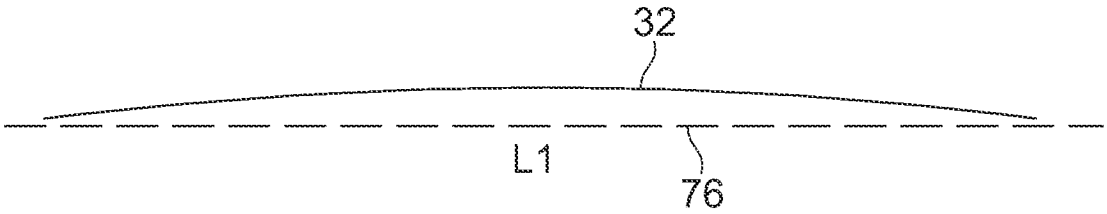
FIG. 9 illustrates a side view of the vertical frame stay of FIG. 8 according to an exemplary embodiment.

FIG. 9 illustrates a side view of the vertical frame stay 32 of FIG. 8 according to an exemplary embodiment. As illustrated, the vertical frame stay 32 is curved. The amount of arc in comparison to a straight line 76 in some embodiments forms a distance L1 between the center of the frame stay 32 and the straight line 76 in the range of half an inch to two inches For instance, for a typical adult-sized backpack 10, the distance L1 may be approximately one inch.

Figure 10:
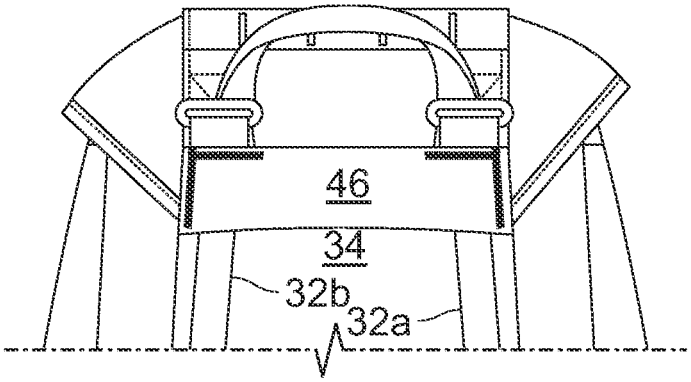
FIG. 10 illustrates a single upper frame stay pocket disposed on the top of the back panel for holding the top ends of the right and left frame stays in position using hook and loop fasteners according to an exemplary embodiment.

FIG. 10 illustrates a single upper frame stay pocket 46 disposed on the top of the back panel 34 for holding the top ends of the right and left frame stays 32*a,b* in position using hook and loop fasteners according to an exemplary embodiment. In this embodiment, both the top end of the right frame stay 32*a* and the top end of the left frame stay 32*b* are inserted into the single upper frame stay pocket 46, which spans between a top-right area and a top-left area of the back panel 34. The top end of the left frame stay 32*b* is positioned at the left side of the upper pocket 46 and the top end of the right frame stay 32*a* is positioned to the right side of the upper pocket 46. The two opposing inner sides of the upper frame stay pocket 46 respectively include hook and loop fasteners such as Velcro® thereby naturally affixing these opposing inner sides together. Along with the compression of the frame stays 32*a,b* between the upper and lower pockets 46, 44, the hook and loop fasteners inside the upper pocket 46 help prevent the top end of the right frame stay 32*a* and the top end of the left frame stay 32*b* from moving laterally within the upper pocket 46 when the hook and loop fasteners are secured together. In this way, the top ends of the right and left frame stays 32*a,b* do not move across the upper pocket 46 without manual assistance of the user to pull apart the hook and loop fasteners.

Figure 11:
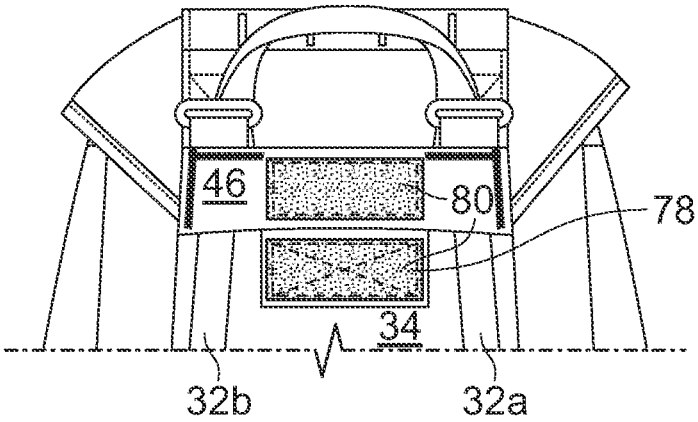
FIG. 11 illustrates a single upper frame stay pocket disposed on the top of the back panel for holding the top ends of the right and left frame stays in position using a flap according to an exemplary embodiment.

FIG. 11 illustrates a single upper frame stay pocket 46 disposed on the top of the back panel 34 for holding the top ends of the right and left frame stays in position using a flap 78 according to an exemplary embodiment. In this embodiment, the back panel 34 includes a flap 78 extending upwards from below the upper frame pocket 46. The flap 78 is securable utilizing one or more fasteners to a middle portion of the single upper frame stay pocket 46. The fasteners may be hook and loop fasteners 80 such as Velcro® or may be other types of fasteners such buttons or even magnets. When folded upwards and attached to the middle portion of the pocket 48, the flap 78 prevents the top end of the right frame stay 32*a* and the top end of the left frame stay 32*b* from moving from their respective positions across the single upper frame stay pocket 46 because they will impact the sides of the flap 78. As with the previous embodiment, manual assistance of the user is required to undo the one or more fasteners and fold the flap 78 away from the single upper frame stay pocket 46 into the position shown in FIG. 11 in order to allow the top ends of the frame stays 32*a,b* to move across the upper frame stay pocket 46.

Figure 12:
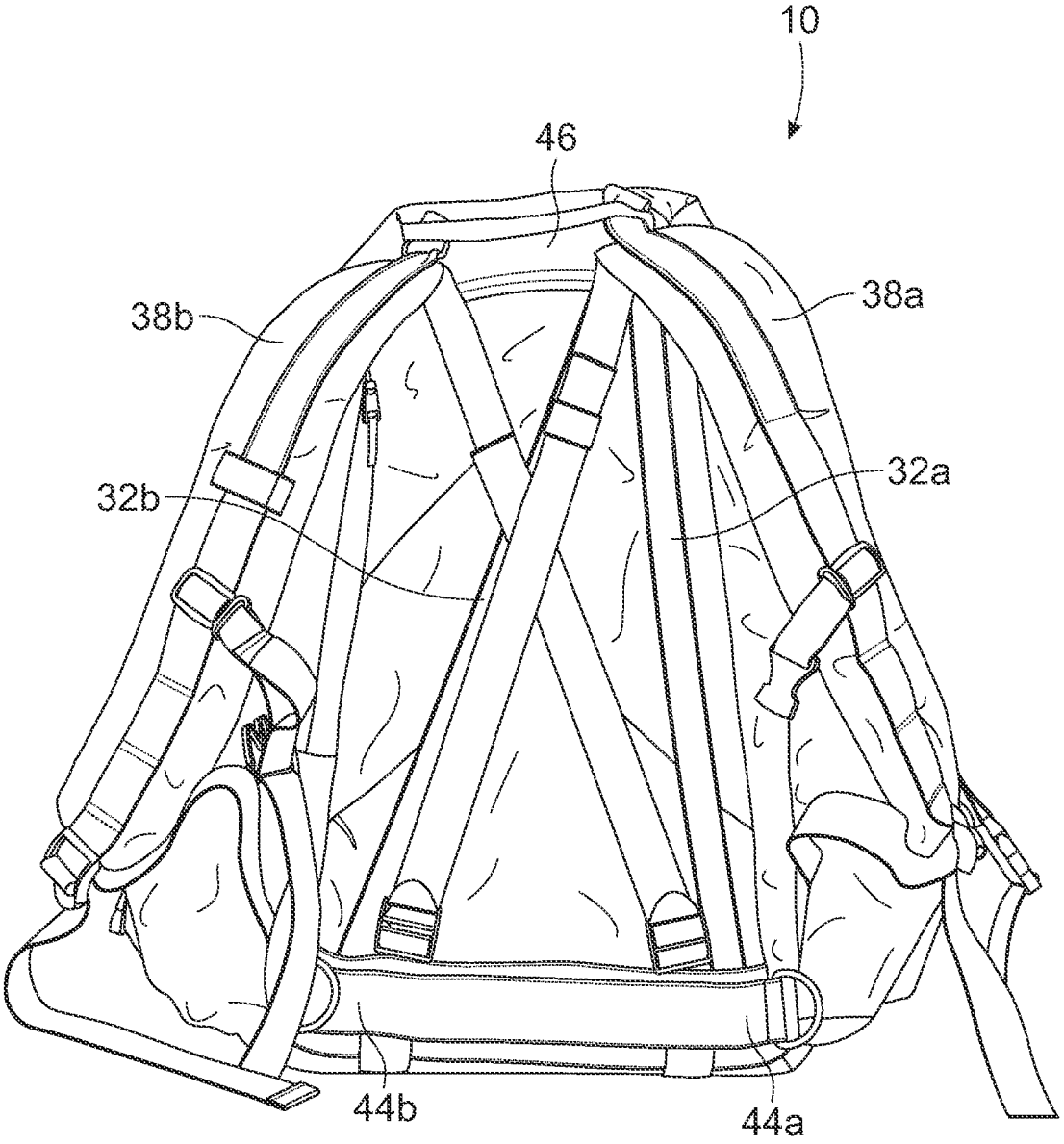
FIG. 12 illustrates a back elevational view of a backpack when the top end of the left frame stay is moved across the top frame stay pocket to the opposite side to thereby remove compression tension and allow for removing the vertical frame stay according to an exemplary embodiment.

Exemplary benefits of having a single, wide upper frame stay pocket 46 as disclosed in the embodiments of FIGS. 9 and 10 is to allow easy removal of the vertical frame stays 32*a,b* by the user. For instance, FIG. 12 illustrates a back elevational view of a backpack 10 when the top end of the left frame stay 32*b* is moved across the top frame stay pocket 46 to the opposite side to thereby remove compression force and allow for removing the vertical frame stay 32*b* according to an exemplary embodiment.

When the upper frame stay pocket 46 has hook and loop fasteners on the inside opposing layers (i.e., the embodiment illustrated in FIGS. 10 and 12), a method of removing the left and right vertical frame stays from the backpack 10 involves the user first pulling apart the hook and loop fasteners of the upper frame stay pocket 46 to thereby open an inner area of the upper pocket 46. While the inner area of the pocket 46 is opened in this manner, the user moves the top end of the left frame stay 32*b* laterally within the pocket 46 from the top-left area to the top-right area to the position as shown in FIG. 12. When moved laterally like this, the frame stay 32*b* is no longer held in compression between the upper frame stay pocket 46 and the bottom left corner frame stay pocket 44*b*. The user can therefore remove the top end of the left frame stay 32*b* from the upper frame stay pocket 46 and likewise remove the bottom end of the left frame stay 32*b* from the bottom-left frame stay pocket 44*b*. A similar process is also performed to remove the right frame stay 32*a*. For instance, while the inner area of the single upper frame stay pocket 46 is opened, the user moves the top end of the right frame stay 32*a* laterally within the upper pocket 46 from the top-right area to the top-left area. The user then removes the top end of the right frame stay 32*a* from the upper pocket 46 and removes the bottom end of the right frame stay 32*a* from the bottom-right frame stay pocket 44*a*.

Regarding the flap 78 embodiment of FIG. 11, a method of removing the right and left frame stays from the backpack 10 is as follows. The user first undoes the fasteners 80 and folds the flap 78 downward away from the middle portion of the single upper frame 46 stay pocket so that the flap 78 is adjacent the outside surface of the back panel 34 (below the top pocket 46) as shown in FIG. 11. While the flap 78 is folded away from the upper frame stay pocket 46 in this manner, the user moves the top end of the right frame stay 32*a* laterally within the single frame stay pocket 46 from the top-right area to the top-left area. The compression force is thereby released and the user can then remove the top end of the right frame stay 32*a* from the upper pocket 46 and remove the bottom end of the right frame stay 32*a* from the bottom-right frame stay pocket 44*a*. Also while the flap 78 is folded away from the single upper frame stay pocket 46, the user moves the top end of the left frame stay 32*b* laterally within the upper pocket 46 from the top-left area to the top-right area. The user then removes the top end of the left frame stay 32*b* from the upper pocket 46 and removes the bottom end of the left frame stay 32*b* from the bottom-left frame stay pocket 44*b*.

Figure 13:
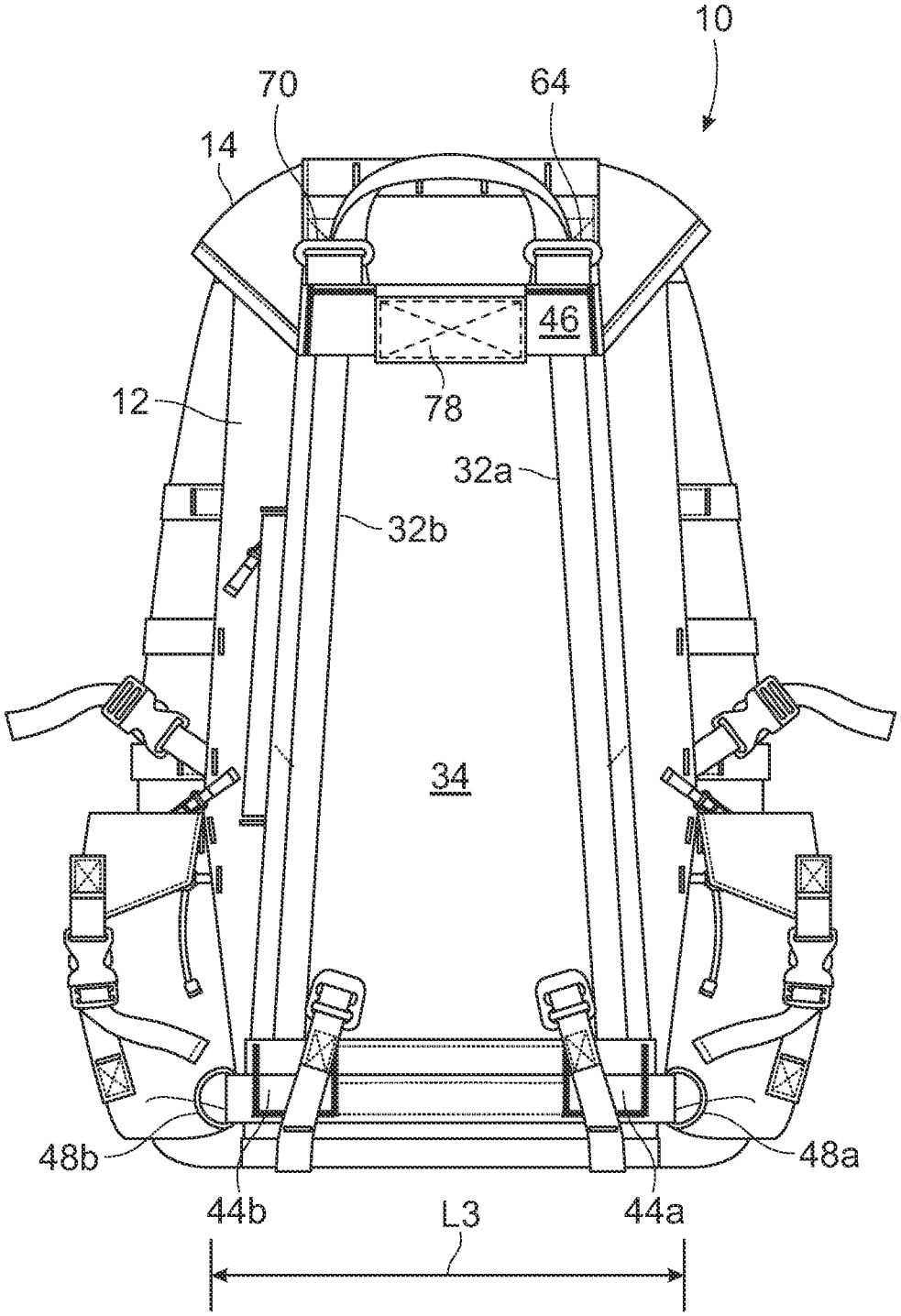
FIG. 13 illustrates an elevational view of the back panel of the backpack of FIG. 1 with the shoulder straps omitted for better clarity of the vertical frame stays.

FIG. 13 illustrates an elevational view of the back panel 34 of the backpack 10 of FIG. 1 with the shoulder straps 38 omitted for better clarity of the vertical frame stays 32. As illustrated, the right and left frame stays 32*a,b* may be implemented by either rigid or semi-rigid bars in different embodiments. Semi-rigid bars with some spring action provide some shock absorption by bending slightly as the user steps or jumps and help reduce the vertical movement of the pack 10 relative to the user. The frame stays 32*a,b* in some embodiments are held in compression to stay in their pockets 46, 44*a,b* but they are removable by the user either manually bending the frame stay 32*a,b* (if semi-rigid stay) and/or by stretching the pocket opening 46, 44*a,b* (if rigid stay). In some embodiments, the frame stays 32*a,b* are curved with a concave shape toward the user's body and a convex shape toward the backpack 10 contents. Options for material for the stays 32*a,b* include (but are not limited to) plastic, metal, wood, bamboo, carbon fibre, aluminum, or composites in different embodiments.

Figure 14:
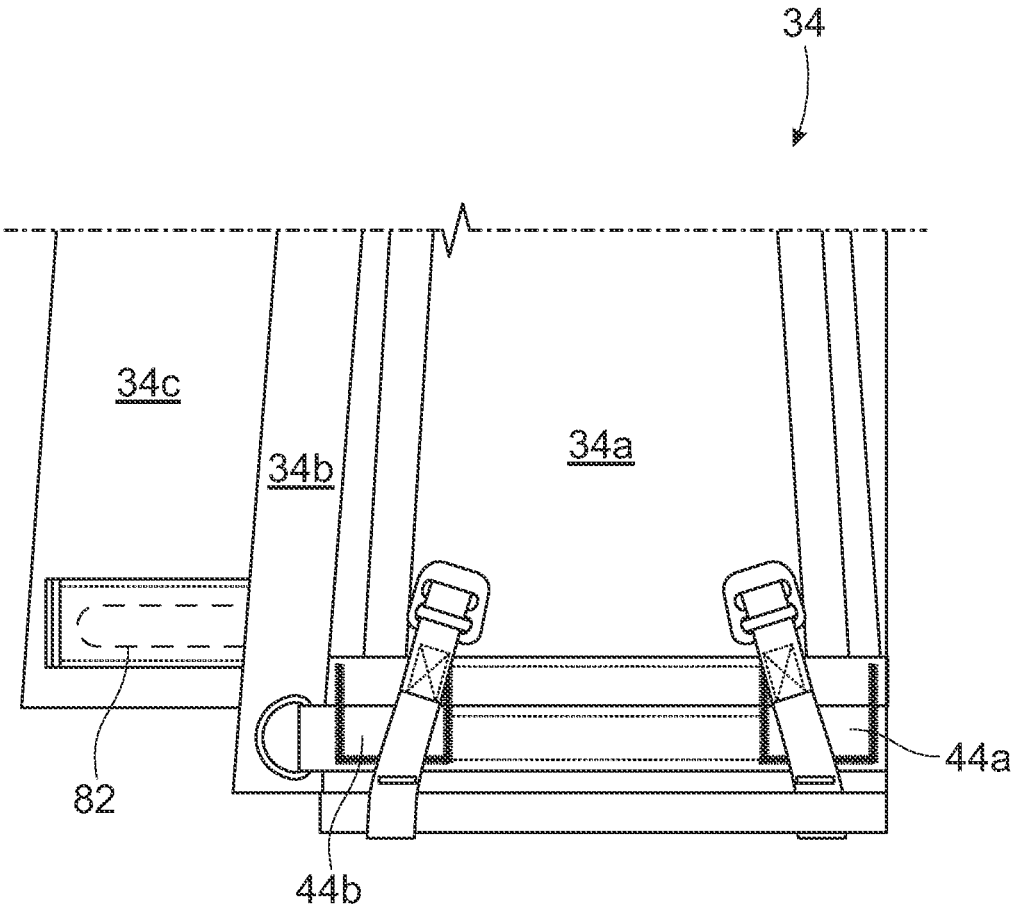
FIG. 14 illustrates how the back panel of the backpack may be implemented with a plurality of layers having a horizontal bottom stay embedded between the layers according to exemplary embodiment.

FIG. 14 illustrates how the back panel 34 of the backpack 10 may be implemented with a plurality of layers having a horizontal bottom stay 82 embedded between the layers according to exemplary embodiment. In this embodiment, the back panel 34 includes three layers: an outer layer 34*a*, and foam layer 34*b*, and a liner layer 34*c*. The outer layer 34*a* faces toward the user's body during usage, the foam layer 34*b* provides some cushion between the user's body and the contents of the backpack 10, and the lining layer 34*c* forms the inside of the main bag portion 12 adjacent the contents placed into the backpack 10 by the user. A bottom frame stay 82 is formed by a bar member being either rigid or semi-rigid and mounted horizontally between the bottom-left area and the bottom-right area of the back panel 34. In this embodiment, the bottom frame stay 82 is mounted between the lining layer 34*c* and the foam layer 34*b* during manufacture of the back panel 34. The bottom frame stay 82 is thereby hidden to the user within the back panel 34 and is not user-removable in this embodiment.

Figure 15:
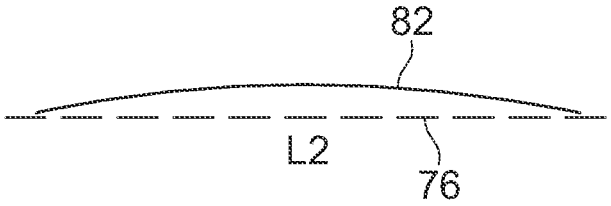
FIG. 15 illustrates a side view of the bottom frame stay while resting on a flat surface such as a table according to an exemplary embodiment.

FIG. 15 illustrates a side view of the bottom frame stay 82 while resting on a flat surface 76 such as a table according to an exemplary embodiment. Similar to the right and left vertical frame stays 32, the bottom frame stay 82 has rounded corners and is curved. The amount of arc in this embodiment is such that the middle of frame stay 82 is a distance L2 of about half an inch in comparison with a straight line 76. During installation, the bottom frame stay 82 is mounted on one or more layers of the back panel 34 with the concave shape toward the body of the user and the convex shape toward contents of the main bag portion. The bottom frame stay 82 may be made of materials the same as the right and left frame stays 32 such as wood, aluminum, or carbon fibre, for example.

In some embodiments, lower pockets are disposed on the outside layer 34*a*, inner layer(s) 34*b*, and/or liner layer 34*c* of the back panel 34 and have their openings facing toward each other (i.e., horizontally toward to a center line of the back panel 34) in order to accept respective ends of a horizontally orientated frame stay 82. The distance between the left and right pockets is such that the horizontal frame stay 82 is securely held in compression and will not accidentally fall out of the pockets.

Figure 16:
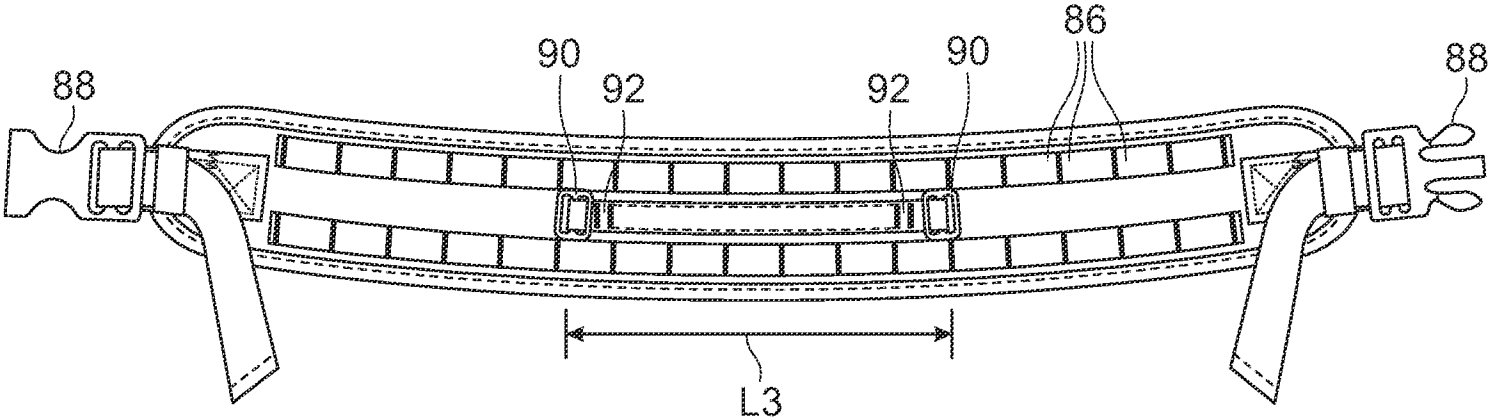
FIG. 16 illustrates an elevational view of an outside of a hipbelt according to an exemplary embodiment.

FIG. 16 illustrates an elevational view of an outside of a hipbelt 84 according to an exemplary embodiment. The outside of the hipbelt 84 is the side that faces away from the user while the hipbelt 84 is worn and attached to the backpack 10. The hipbelt 84 includes a plurality of gear loops 86 formed by bartack webbing separated by a predetermined distance such as 1.5". First and second sides of a snap buckle 88 are provided for attaching the hipbelt 84 around the user's waist. Further, the hipbelt 84 includes two three-bar adjusters 90 for attachment of the hipbelt 84 to the right bottom ring 48*a* and the left bottom ring 48*b* on the back panel 34 of the backpack 10.

The two three-bar adjusters 90 are attached to the hipbelt 84 by short lengths of strap 92 (e.g., webbing) and are separated by a distance L3 which corresponds to the distance between the bottom rings 48*a,b* shown on FIG. 13. For instance, the distance L3 may be approximately 9.5" in some embodiments. The middle bar of each of the two three-bar adjusters 90 is secured via the strap webbing 92 to the hipbelt 84. In some embodiments the three-bar adjusters 90 are made of plastic; however, metal and other materials may be used in other embodiments.

Figure 17:
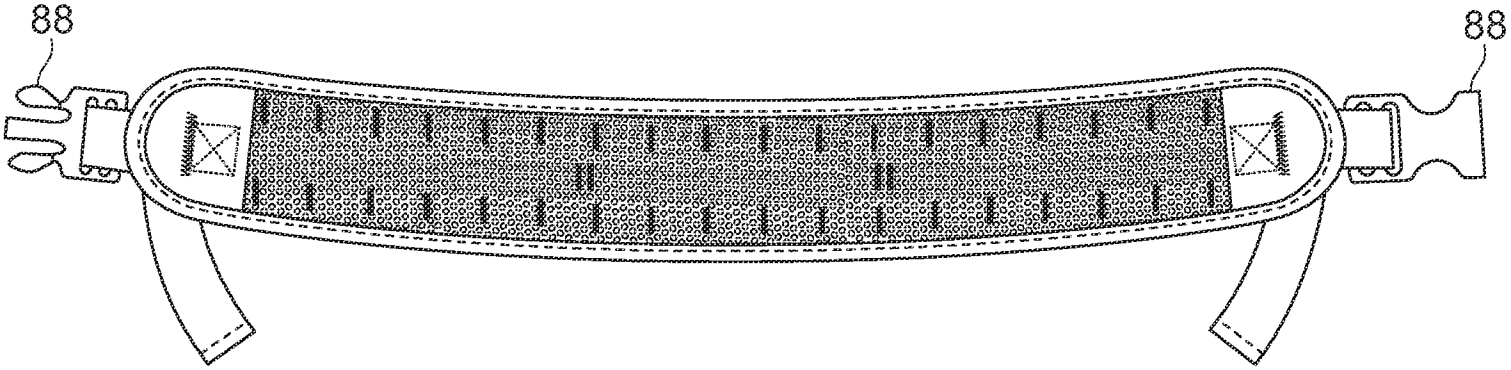
FIG. 17 illustrates an elevational view of an inner side of the hipbelt of FIG. 16 according to an exemplary embodiment.

FIG. 17 illustrates an elevational view of an inner side of the hipbelt 84 of FIG. 16 according to an exemplary embodiment. The inner side is the side of the hipbelt 84 facing toward the user's body during usage.

Figure 18:
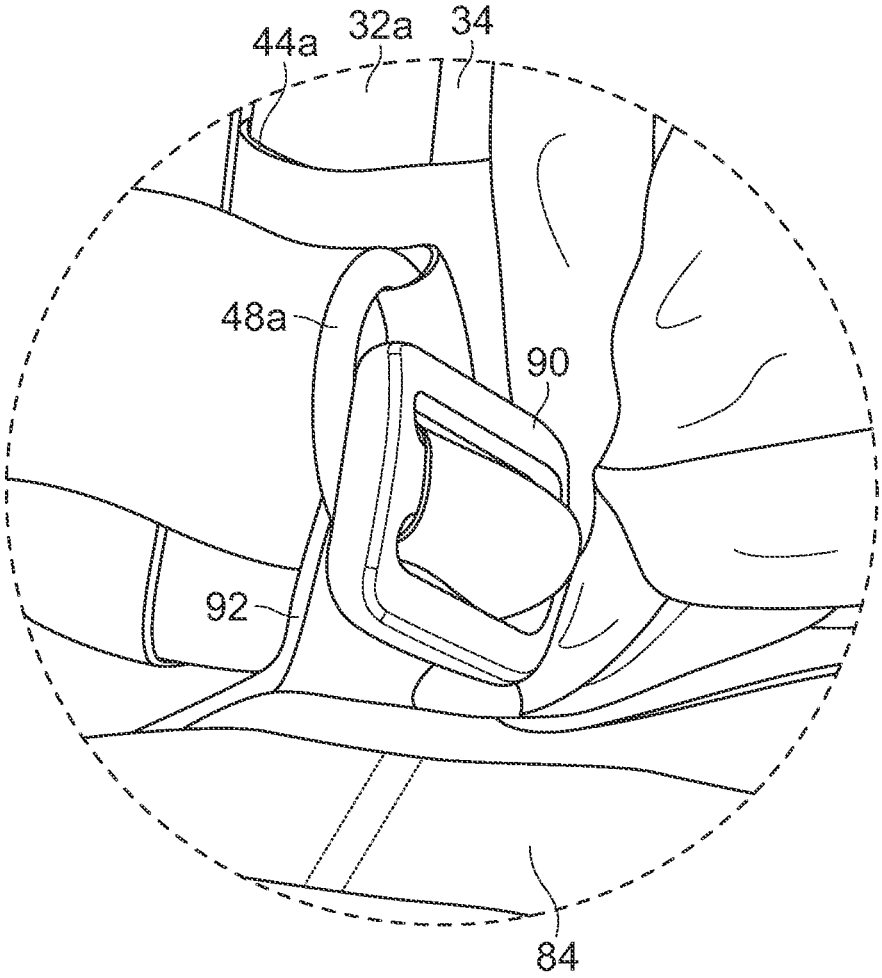
FIG. 18 illustrates an enlarged perspective view of a pin type connection between the hipbelt of FIG. 16 and the back panel of the backpack of FIG. 3 according to an exemplary embodiment.

FIG. 18 illustrates an enlarged perspective view of a pin type connection between the hipbelt 84 of FIG. 16 and the back panel 34 of the backpack 10 of FIG. 3 according to an exemplary embodiment. The pin type connection in this embodiment is formed by inserting a three-bar adjuster 90 on the hipbelt 84 through a corresponding bottom ring 48 attached to the back panel 34 of the backpack 10. A similar attachment is done on both the right and left sides. The three-bar adjuster 90 when turned sideways can be inserted through the bottom ring 48, which may be a D-ring in some embodiments, but then naturally rests in an orientation and position that does not allow the adjuster 90 to escape the ring 48 without manual assistance from the user. In this way, the adjuster 90 through the ring 48 forms a pin connection that allows rotational movement between the hipbelt 84 and the backpack 10 but does not allow lateral or vertical motion therebetween.

In other embodiments, other types of pin connections such as custom pin connections with mating connectors on the backpack 10 and the hipbelt 84 may also be utilized, which may include connection using tensile fabric.

Regardless of the form of the pin connection, the pin connection attachment between the hipbelt 84 and the backpack 10 assists with comfort and stability by minimizing twisting forces when the user's hip action moves the hipbelt 84 relative to the backpack 10. The pin connection provides restraint at the connection location to the hipbelt 84, and, with the addition of an elastic material if desired, allows shock absorption and damping effect; however, the pin connection resists vertical and lateral motion and therefore the hipbelt 84 does transfer load on the hips of the user which increases comfort and carrying capacity.

Figure 19:
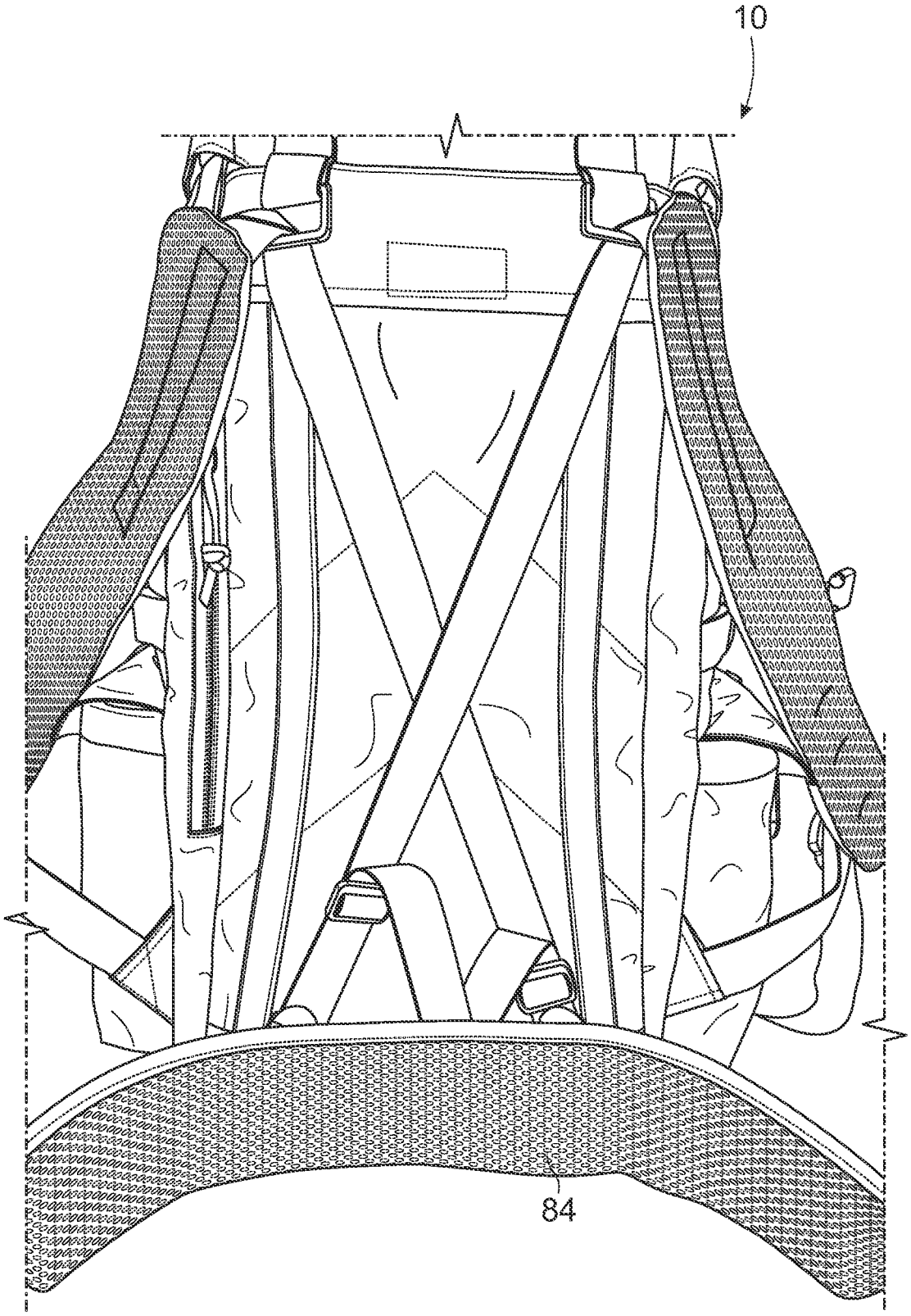
FIG. 19 illustrates a rear elevational view of the backpack of FIG. 1 with hipbelt attached according to exemplary embodiment.

FIG. 19 illustrates a rear elevational view of the backpack 10 of FIG. 1 with hipbelt 84 attached according to exemplary embodiment. In this embodiment, the hipbelt 84 may be selectively attached and detached by the user according to the user's preference and needs.

Figure 20:
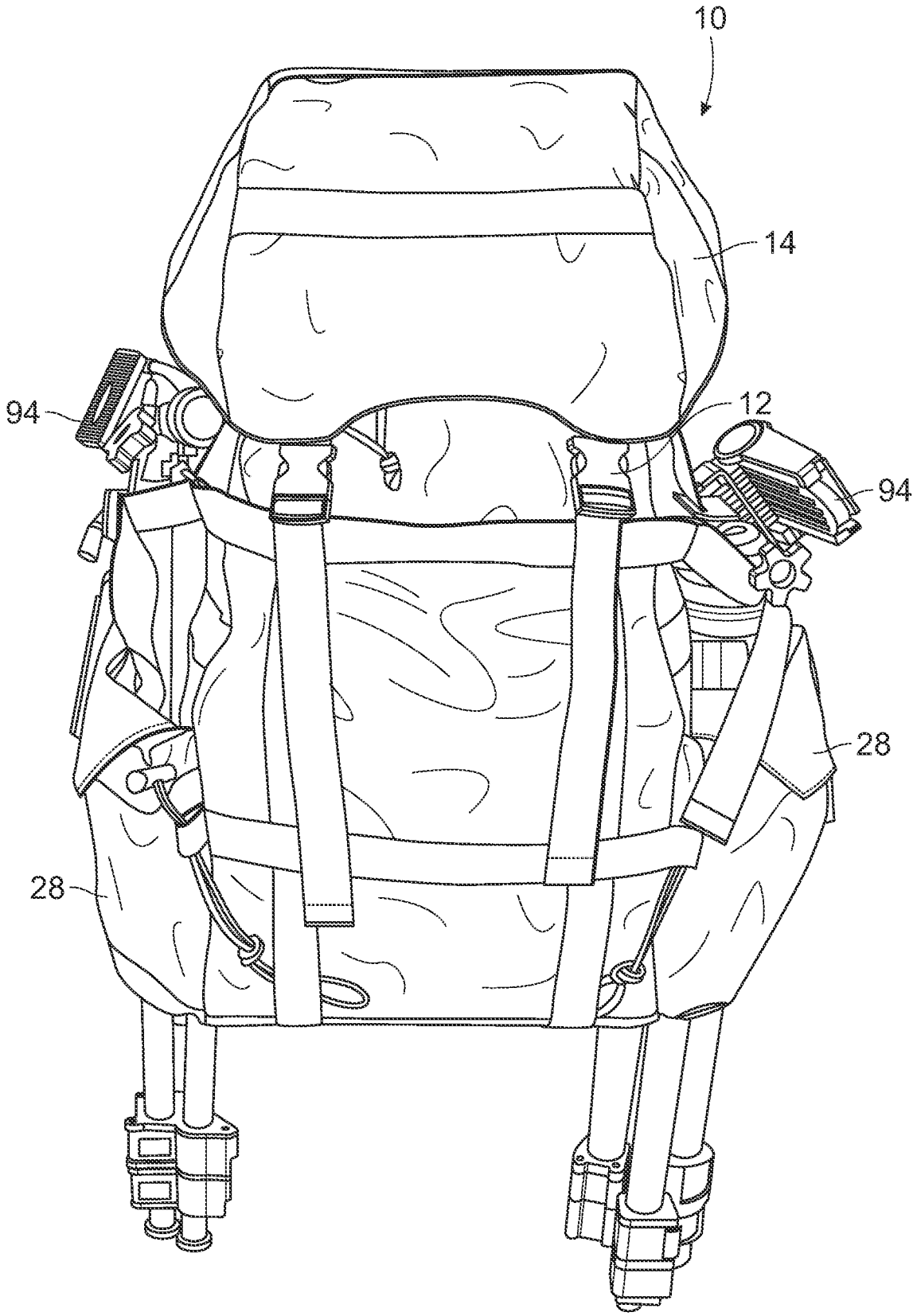
FIG. 20 illustrates a front elevational view of the backpack of FIG. 1 with passthough side pockets for carrying extra-long or awkward items according to an exemplary embodiment.

FIG. 20 illustrates a front elevational view of the backpack 10 of FIG. 1 with passthough side pockets 28 for carrying extra-long or awkward items according to an exemplary embodiment. In some embodiments, the side pockets 28 are passthrough pockets such that there is a gap between the back of the pocket 28 and the side of the main bag portion 12 for insertion of long items.

In this embodiment, each side pocket 28 is attached with side seams but having a gap between the top and bottom of the side pockets 28 to thereby allow long items such as camera tripods 94, skis, musical instruments, tubes, rope, rolled maps, etc. to be inserted vertically into and through the gap This structure allows for long or otherwise awkward items to be fastened to the backpack 10 while still retaining the usage of the side pockets 28 for other purposes.

In an exemplary embodiment, a backpack 10 includes right and left shoulder straps 38 that each respectively follows a path starting with a fixed connection 62, 68 at a bottom corner of a back panel 34. A padded portion of the shoulder strap 38 extends upwards and then proceeds through an upper ring 64, 70 on the same side of the backpack 10. The strap 38 then extends back down while crossing over to another fixed connection 66, 72 to a bottom corner on the other side of the back panel 34. At the top ring 64, 70, the strap 38 is merely guided back down and is not fixed relative to the ring 64, 70. Curved frame stays 32, 82 on the left, right and bottom of the back panel 34 have concave shape toward the user. A hipbelt 84 attaches to the backpack 10 with pin connections to allow rotational motion therebetween while preventing lateral motion. Outside straps 20, 22 reduce strain on the backpack fabric and side pockets 28 are passthrough for insertion of objects therebetween while still allowing pocket 28 usage.

In some embodiment, the side pockets 28 are attached in a temporary manner such that they can be removed or replaced by the user with larger or smaller sizes, while still remaining in use when a ski or long material is attached.

Exemplary benefits of some of the above-described backpack 10 embodiments include the backpack 10 allowing for customizability to allow for quick removal of the hipbelt 84 to swap for a larger or smaller size, or stiffness. The shoulder strap 38 orientation allows for the pack to self-adjust and balance when in use. The hybrid internal/external frame 32, 82 allows the backpack 10 to function without the hipbelt 84 attached while still providing structure.

In some embodiments, the vertical frame stays 32 are able to be quickly removed and replaced and swapped with other materials. The shape of the frame stays 32 is designed to provide a spring to the frame reducing the overall impact force from up and down movements of the pack 10 due to the equipment in the pack.

Shock absorbers such as elastic material may also be optionally included in the shoulder straps 38 to reduce the vertical motion of the pack when in operation and reduce the impact felt on the body when under stress. This reduces the total displacement of the pack 10 when a person is walking, reducing the overall impact force relative to the user.

The frame stay 32, 82 shape keeps the pack 10 off the user's body providing air flow, and also provides a mechanism for allow the shoulder strap 38 configuration to support the pack 10 from the base. E.g., the shoulder straps 38 that are not fixed at the top only resist lateral movement, and the main pack support is directed to the lower portion of the pack 10.

In some embodiments, the lid 14 has one or more continuous straps 20, 26 which extend to the bottom of the pack 10 and fasten at or near the location of the hipbelt 84, improving the load transfer and distribution. For instance, in some embodiments, two support straps 20, 26 wrap around the lid 14 and bag 12 portion of the pack secured at the top back around to the bottom back. These continuous support straps 20, 26 transfer load forces and reduce the stretching forces on the fabric of the backpack bag 12.

The pack 10 allows for significant customizability where the shoulder straps 38 can be oriented in several positions, the hipbelt 84 can be removed if desired, the frame stays 32, 82 can be made from several types of shaped material (wood, aluminum, carbon fibre), frame stays 32, 82 can be removed to use only the internal support, and parts are easily changeable.

In some embodiments, the pack 10 is also designed so that all the straps 38 and hipbelt 38 can be completely removed. This allows for the pack 10 to reduce in size for transport, or for fastening to a bicycle to be uses as a temporary pannier.

In some embodiments, metal rings 64, 70 are further affixed to the various top and optionally bottom pockets as illustrated (e.g., see FIG. 6 showing top rings and FIG. 7 showing bottom rings) in order to secure the shoulder straps 38. The shoulder strap 38 connections at the bottom rings 62, 66 are fixed whereas, as explained above, the shoulder straps 38 at the top rings 64, 70 pass through the top rings 64, 74 and therefore each strap 38 is merely guided around its respective top ring 64, 70 and is not fixed relative to the top ring 64, 70.

As illustrated in FIGS. 3 and 7, each shoulder strap 38 follows a path that starts with a fixed connection 66 such as a first metal ring or triangular side section 76 attached to a bottom area of the back panel 34. A padded portion of the shoulders strap 38 extends upwards and this is the portion of the strap 38 that rests against the user's chest and shoulders while the backpack is being worn. The shoulder strap 38 then proceeds through the upper ring 64, 70 on the same side of the back panel 34 as it started, but on the way back down the strap crosses over to the other side where it is attached to a bottom ring or other fixed connection point 66, 72 on the other side of the back panel 34. For example, the right side shoulder strap 38*a* starts on the right bottom ring or other fixed connection point 62, passes through the upper right ring 64, and then attaches to the bottom left ring or other fixed connection point 66. Likewise, the left side shoulder strap 38*b* starts on the left bottom ring or other fixed connection point 68, passes through the upper left ring 70, and then attaches to the bottom right ring or other fixed connection point 72. In this way, the shoulder straps 38*a,b* cross each other on their way back down from the top to the bottom and the lifting load carried by these straps 38*a,b* is supported primarily by the bottom 18 of the backpack 10 rather than the top.

The fact that the shoulder straps 38 pass through the top rings 64, 70 but are not otherwise fixed in position relative to the top rings 64, 70 allows the tilt of the backpack 10 to change as the user moves and steps. The backpack 10 is not held directly against the users back and instead leans slightly away facilitating airflow between the backpack 10 and the user. Likewise, the crossing action of the shoulder straps 38 and non-fixed connection at the top rings 64, 70 helps ensure that the center of weight of the load stays better balanced with the user even when the user tilts side to side.

In some embodiments, the shoulder straps 38 or a portion of the shoulder straps 38 is made with an elastic material to help with dampening and shock absorption.

Further exemplary benefits of certain embodiments include the easy removal and customization of all straps 38, the beneficial load transfer enabled by the frame support system disclosed herein, and the flexibility of the frame stays 32, 82 and shoulder strap 38 shock absorber reducing body impacts. Furthermore, the pack 10 is highly customizable and also works with no frame stays 32, 84, partial frame 32, 84, hipbelt 84, or no hipbelt 84, etc.

In some embodiments, the connection between the waist strap (i.e., hipbelt 84) connection to the backpack 10 is a pin connection which can be removed and easily replaced, while also allowing for unlimited circular (rotational) movement. In some embodiments, rather than insertion of a three-bar adjuster 90 into a metal ring 48, this pin connection may be implemented by a custom fabrication of a custom pin or slip connection.

In some embodiments, fabrication of the fixed internal hip frame 82 coincides with the external vertical frame components 32, as well as the attachment location of the bottom rings 48 for the hipbelt 84. In some embodiments, the location of the fixed connection points for all these items are the same.

Larger and smaller versions of the pack 10 may be developed in different embodiments and any desired materials may be utilized for fabrication purposes. For instance, in some embodiments, sustainable materials are utilized.

In some embodiments, all straps are removable and fasteners are included to allow the pack 10 to be installed as bike pannier.

Further, in some embodiments, quick release buckles are utilized to allow the pack 10 to be dropped if required during an emergency event.

In some embodiments, the manner of locking the pin type connection between the hipbelt 84 and pack 10 is user selectable between locked and unlock configurations so it can be disengaged or engaged. For example, in some applications, the pack 10 is locked from movement when travelling uphill, and allowed to freely move when travelling downhill or on level terrain.

Although the invention has been described in connection with preferred embodiments, it should be understood that various modifications, additions and alterations may be made to the invention by one skilled in the art without departing from the spirit and scope of the invention.

For example, the steps of the methods described herein are not restricted to the exact order described, and, in other configurations, described steps may be omitted or other intermediate steps added.

Although the frame stay pockets 44, 46 for holding the vertical frame stays 32 are illustrated and described above as being on the outside of the back panel 34; in other embodiments, the back panel 34 further includes one or more other pockets that are not visible because they are on an inside of the back panel. In this way, the vertical frame stays 32 may be mounted on an inner surface layer 34*c* of the back panel. Likewise, other embodiments, the vertical frame stays 32 are mounted between one or more layers 34*a,b,c* of the back panel fabric such that the vertical frame stays 32 are hidden from the user similar to as described above for the horizontal frame stay 82. In some embodiments, the horizontal frame stay 82 is mounted on either the outside surface or the inside surface of the back panel 34 such that the horizontal frame stay 82 may be removable and installable by the user for different applications. In general, different embodiments can have any of the frame stays 32, 82 mounted either inside or outside the backpack 10, or between layers of the back panel 34.

In other embodiments, rather than utilizing frame stays being bar members, the frame stays may be implemented utilizing other techniques such as having a solid plate integrated within the back panel 34.

Although D-shaped and oblong rings are illustrated for the rings in the above description and figures, other ring shapes such as tubular, elongated, circular, flat, etc. and configurations such as carabiner-style locking/unlock rings, split rings, buckles, etc. may also be utilized in other embodiments. For instance, the upper rings 64, 70 acting as non-fixed, passthrough connections for the shoulder straps 38 may in some embodiments be implemented by tubular elbow joints that guide the straps 38 back down without otherwise fixing the straps 38 to the upper portion of the back panel 34.

Although hook and loop fasteners are described above for the upper frame pocket 46 and flap 78 in FIGS. 10 and 11 to help prevent the top ends of the frame stays 32 from moving laterally across the single upper frame stay pocket 46, other types of fasteners such buttons, snaps, magnets, clips, etc. may be used in a similar manner in other embodiments. Further, although a single upper frame stay pocket 46 is beneficial to facilitate user removal of the vertical frame stays 32, in other embodiments, two upper frame stay pockets may be used instead of a single upper frame stay pocket 46. In some embodiments, the right side of the back panel 34 has upper and lower pockets for holding the right frame stay 32*a*, and the left side of the back panel 34 also has upper and lower pockets for holding the left frame stay 32*b*.

As used herein, the terms backpack and pack are interchangeable. Furthermore, embodiments described herein as being a backpack may also be utilized as a frontpack worn on a user's chest if so desired.

Functions of single elements may be separated into multiple elements, or the functions of multiple elements may be combined into a single elements.

All combinations and permutations of the above described features and embodiments may be utilized in conjunction with the invention. For example, the backpack 10 may be utilized with external vertical frame stays 32 with hipbelt 84, with external frame stays 32 without hipbelt 84, without vertical frame stays 32 with/without hipbelt 84, without any shoulder straps 38 as bike pannier, etc.

What is claimed is:

1. A backpack comprising:

a main bag portion, the main bag portion having a back panel that faces a body of a user when the backpack is worn by the user;

a right shoulder strap extending upwards from a first fixed connection located within a bottom-right area of the back panel, passing through a first ring secured within a top-right area of the back panel, and extending down from the first ring to a second fixed connection located within a bottom-left area of the back panel, wherein the right shoulder strap passes through the first ring but is not otherwise fixed to the first ring;

a left shoulder strap extending upwards from a third fixed connection located within the bottom-left area of the back panel, passing through a second ring secured within a top-left area of the back panel, and extending down from the second ring to a fourth fixed connection located within the bottom-right area of the back panel, wherein the left shoulder strap passes through the second ring but is not otherwise fixed to the second ring;

a right frame stay formed by a first bar member mounted vertically on a right side of the back panel; and a left frame stay formed by a second bar member mounted vertically on a left side of the back panel;

wherein both the right frame stay and the left frame stay are mounted on an outside of the back panel and are removable and installable by the user;

a bottom end of the right frame stay is inserted into a first frame stay pocket formed within the bottom-right area of the back panel;

a bottom end of the left frame stay is inserted into a second frame stay pocket formed within the bottom-left area of the back panel; and both a top end of the right frame stay and a top end of the left frame stay are inserted into a single upper frame stay pocket that spans between the top-right area and the top-left area of the back panel.

2. The backpack of claim 1, wherein a plurality of opposing inner sides of the single upper frame stay pocket respectively include a plurality of hook and loop fasteners thereby affixing the opposing inner sides together and preventing the top end of the right frame stay and the top end of the left frame stay from moving laterally within the single upper frame stay pocket without manual assistance of the user to pull apart the hook and loop fasteners.

3. A method of removing the right frame stay and the left frame stay from the backpack of claim 2, the method comprising:

pulling apart the hook and loop fasteners of the single upper frame stay pocket to thereby open an inner area of the single upper frame stay pocket;

while the inner area of the single upper frame stay pocket is opened, moving the top end of the right frame stay laterally within the single frame stay pocket from the top-right area to the top-left area and then removing the top end of the right frame stay from the single upper frame stay pocket and removing the bottom end of the right frame stay from the first frame stay pocket; and while the inner area of the single upper frame stay pocket is opened, moving the top end of the left frame stay laterally within the single frame stay pocket from the top-left area to the top-right area and then removing the top end of the left frame stay from the single upper frame stay pocket and removing the bottom end of the left frame stay from the second frame stay pocket.

4. The backpack of claim 1, wherein the back panel includes a flap extending upwards from below the single upper frame pocket and securable utilizing one or more fasteners to a middle portion of the single upper frame stay pocket and preventing the top end of the right frame stay and the top end of the left frame stay from moving from their respective positions within the single upper frame stay pocket without manual assistance of the user to undo the one or more fasteners and fold the flap away from the single upper frame stay pocket.

5. A method of removing the right frame stay and the left frame stay from the backpack of claim 4, the method comprising:

undoing the fasteners and folding the flap away from the middle portion of the single upper frame stay pocket so that the flap is adjacent an outside surface of the back panel;

while the flap is folded away from the single upper frame stay pocket, moving the top end of the right frame stay laterally within the single frame stay pocket from the top-right area to the top-left area and then removing the top end of the right frame stay from the single upper frame stay pocket and removing the bottom end of the right frame stay from the first frame stay pocket; and while the flap is folded away from the single upper frame stay pocket, moving the top end of the left frame stay laterally within the single frame stay pocket from the top-left area to the top-right area and then removing the top end of the left frame stay from the single upper frame stay pocket and removing the bottom end of the left frame stay from the second frame stay pocket.

6. The backpack of claim 1, wherein both the right frame stay and the left frame stay are curved and are mounted on the back panel having a concave shape toward the body of the user and a convex shape toward contents of the main bag portion.

7. The backpack of claim 1, wherein both the right frame stay and the left frame stay are made of a material selected from the group consisting of wood, aluminum, and carbon fibre.

8. The backpack of claim 1, further comprising a bottom frame stay formed by a bar member mounted horizontally between the bottom-left area and the bottom-right area of the back panel.

9. The backpack of claim 8, wherein the bottom frame stay is curved and is mounted on the back panel having a concave shape toward the body of the user and a convex shape toward contents of the main bag portion.

10. The backpack of claim 8, wherein the bottom frame stay is mounted between a plurality of layers of the back panel and is thereby hidden to the user within the back panel.

11. The backpack of claim 1, further comprising:

a lid section for covering an opening at a top of the main bag portion; and a first plurality of vertically orientated straps that extend downward from the lid section and are detachably coupled to a second plurality of vertically orientated straps that extend downward along a front panel of the main bag portion, the front panel facing away from the body of the user when the backpack is worn by the user;

wherein the second plurality of vertically orientated straps extend down an entire height of the front panel to a plurality of fixed connections.

12. The backpack of claim 11, wherein the second plurality of vertically orientated straps further extend around a bottom of the main bag portion and the plurality of fixed connections are on a bottom area of the back panel.

13. The backpack of claim 1, further comprising a hipbelt detachably coupled to the back panel with one or more pin connections.

14. The backpack of claim 1, further comprising:

a right bottom ring secured within the bottom-right area of the back panel; and a left bottom ring secured within the bottom-left area of the back panel.

15. The backpack of claim 14, further comprising:

a hipbelt having a first three-bar adjuster attached from a middle bar of the first three-bar adjuster to a side of the hipbelt facing away from the body of the user during usage via a first length of strap, and a second three-bar adjuster attached from a middle bar of the second three-bar adjuster to the side of the hipbelt facing away from the body of the user during usage via a second length of strap;

wherein the first three-bar adjuster and the second three-bar adjuster are sized such that they can respectively be inserted by the user through the right bottom ring and the left bottom ring to thereby attach the hipbelt to the main bag portion of the backpack, and can respectively be removed by the user through the right bottom ring and the left bottom ring to thereby detach the hipbelt from the main bag portion of the backpack.

16. A backpack comprising:

a main bag portion, the main bag portion having a back panel that faces a body of a user when the backpack is worn by the user;

a right shoulder strap extending upwards from a first fixed connection located within a bottom-right area of the back panel, passing through a first ring secured within a top-right area of the back panel, and extending down from the first ring to a second fixed connection located within a bottom-left area of the back panel, wherein the right shoulder strap passes through the first ring but is not otherwise fixed to the first ring;

a left shoulder strap extending upwards from a third fixed connection located within the bottom-left area of the back panel, passing through a second ring secured within a top-left area of the back panel, and extending down from the second ring to a fourth fixed connection located within the bottom-right area of the back panel, wherein the left shoulder strap passes through the second ring but is not otherwise fixed to the second ring;

a right bottom ring secured within the bottom-right area of the back panel;

a left bottom ring secured within the bottom-left area of the back panel; and a hipbelt having a first three-bar adjuster attached from a middle bar of the first three-bar adjuster to a side of the hipbelt facing away from the body of the user during usage via a first length of strap, and a second three-bar adjuster attached from a middle bar of the second three-bar adjuster to the side of the hipbelt facing away from the body of the user during usage via a second length of strap;

wherein the first three-bar adjuster and the second three-bar adjuster are sized such that they can respectively be inserted by the user through the right bottom ring and the left bottom ring to thereby attach the hipbelt to the main bag portion of the backpack, and can respectively be removed by the user through the right bottom ring and the left bottom ring to thereby detach the hipbelt from the main bag portion of the backpack.

* * * * *